United States Patent [19]

Jao et al.

[11] Patent Number: 4,997,584

[45] Date of Patent: Mar. 5, 1991

[54] PROCESS FOR PREPARING IMPROVED OVERBASED CALCIUM SULFONATE

[75] Inventors: Tze C. Jao; Jayne M. Vaccaro, both of Fishkill, N.Y.; Leonard A. Matthews, Port Arthur, Tex.

[73] Assignee: Texaco Inc., White Plains, N.Y.

[21] Appl. No.: 488,157

[22] Filed: Mar. 5, 1990

[51] Int. Cl.[5] ..... C10M 135/10

[52] U.S. Cl. ..... 252/33; 252/18; 252/25; 252/33.2; 252/33.4

[58] Field of Search ..... 252/39, 33, 18, 25, 252/33.2, 33.4

[56] References Cited

U.S. PATENT DOCUMENTS

| | | | |
|---|---|---|---|
| 4,086,170 | 4/1978 | Clippelier | 252/33 |
| 4,427,559 | 1/1984 | Whittle | 252/33.2 |
| 4,604,219 | 8/1986 | Whittle | 252/18 |
| 4,664,822 | 5/1987 | Hunt | 252/33.4 |
| 4,668,409 | 5/1987 | Yamaguchi | 252/33.4 |
| 4,780,224 | 10/1988 | Jao | 252/33.4 |
| 4,810,396 | 3/1989 | Jao | 252/33.4 |
| 4,879,053 | 11/1989 | Matthews | 252/25 |
| 4,880,550 | 11/1989 | Hunt | 252/25 |

*Primary Examiner*—Jacqueline V. Howard

*Attorney, Agent, or Firm*—Robert A. Kulason; James J. O'Loghlin; Vincent A. Mallare

[57] ABSTRACT

A method of preparing a calcium sulfonate having a TBN of 500 where the method comprises reacting CaO, $Ca(OH)_2$ and $H_2O$, and synthetic and natural sulfonates in certain molar ratios, respectively, for a sufficient length of time to produce the overbased calcium sulfonate.

11 Claims, No Drawings

PROCESS FOR PREPARING IMPROVED OVERBASED CALCIUM SULFONATE

BACKGROUND OF THE INVENTION

This invention is an improved process for preparing overbased calcium sulfonates which are used as detergent and reserve alkalinity lubricating oil additives.

In the course of operation, internal combustion engines convert lubricating oil to acidic degradation products. Those acidic degradation products attack and corrode engine parts and catalyze the formation of sludge, thereby reducing lubricity and accelerating wear of moving parts in contact with the lubricating oil.

It is desirable to add basic substances to the lubricating oil which neutralize acids as they are formed in the engine before they reach concentrations sufficient to cause corrosion or to catalyze the sludge reaction. Adding an alkalinity agent to the detergent in motor oil is known as overbasing. Colloidal carbonates of the alkaline earth metals have been found to be well suited for this purpose. These carbonate dispersions are stabilized by oil soluble surface active agents with the sulfonates of the alkaline earth metals in which the sulfonic acid portion of the molecule has a molecular weight of preferably 350 to 600. The sulfonates are made by sulfonation of lubricating oil fractions from petroleum and by sulfonation of alkyl benzenes having the desired molecular weight for this purpose. Benzene alkylates with straight chain alkyl groups are especially desirable.

There is an increasing demand for a greater than 400 TBN overbased sulfonate in the marine lubricant product market. Because of the higher TBN content, less dosage of this product is required in the additive treatment to obtain equivalent or, better diesel engine performance. The current sulfonate overbasing process cannot produce an acceptable 500 TBN overbased sulfonate, because it produces either an insufficiently overbased, too viscous, or base oil-incompatible product. By modifying the current sulfonate overbasing process, a cost-effective new process can make a fluid and base oil-compatible 500 TBN overbased calcium sulfonate that provides an effective protection to marine diesel engines.

In general, the process of preparing oils which contain overbased calcium sulfonates comprises reacting a solution of alkylbenzene sulfonic acids having a molecular weight greater than 400, in oil with calcium oxide or hydroxide and bubbling carbon dioxide through the reaction mixture; thereby incorporating an excess of calcium carbonate into the calcium sulfonate which confers reserve alkalinity to the product.

Thus, it is an object of the present invention to provide a method of producing overbased calcium sulfonates that contain only amorphous calcium carbonate and have a TBN of greater than 400.

DISCLOSURE STATEMENT

U.S. Pat. No. 4,427,559 discloses that a mixture of calcium oxide and calcium hydroxide can be used in the overbased reaction to provide reserve alkalinity to neutral calcium sulfonates. It is reported that when mixtures containing up to 30 percent CaO are used, satisfactory products were obtained. When mixtures of 30 to 50 percent CaO were used, a gelatinous material which plugged the filter were obtained. Concentrations of CaO above 70 percent produced a fluid product containing finely divided particles which could not be filtered and were reflective of light. In this regard, the patent teaches the criticality of the ratio of the calcium oxide to calcium hydroxide in the absence of a promoter in producing acceptable product.

U.S. Pat. No. 4,604,219 discloses that calcium oxide may be used as the sole reserve alkalinity source in overbasing calcium sulfonates. This patent teaches, in the absence of a promoter, that water addition rate and amount are critical in producing a low solids content, filterable product.

U.S. Pat. No. 4,086,170 discloses that overbased calcium sulfonates are prepared by reacting a solution of alkylbenzene sulfonic acids with an excess of a calcium oxide having a medium or low activity toward water and with carbon dioxide. Improved overbasing and filterability of the overbased sulfonate solution were obtained by the use of a promoter for the conversion of the calcium oxide to calcium hydroxide. Recommended promoters include ammonia or organic bases such as monoamines or diamines, e.g. ethylene diamine.

U.S. Pat. No. application No. 4,954,272 discloses a method of preparing a calcium sulfonate having a TBN of 325 where the method comprises reacting CaO, $Ca(OH)_2$ and $H_2O$ in certain molar ratios for a sufficient length of time to produce the overbased calcium sulfonate.

SUMMARY OF THE INVENTION

The present invention provides a process for preparing an improved overbased oil soluble calcium sulfonate having a TBN of 500. The process comprises:

(a) diluting a synthetic sulfonate and a natural sulfonate in a molar ratio of synthetic to natural sulfonate of about 70:30 to about 50:50;

(b) adding to the diluted natural/synthetic sulfonate solution, CaO and $Ca(OH)_2$ in molar ratios of CaO: $Ca(OH)_2$ of about 90:10 to about 20:80 and a charge molar ratio of total lime [CaO and $Ca(OH)_2$]: sulfonate of about 27:1 to about 22:l;

(c) heating the sulfonate mixture to a temperature ranging from about 100° F. to about 170° F. under a pressure ranging from about 0 to about 50 psig;

(d) adding water to the heated sulfonate mixture in a molar ratio of $CaO:H_2O$ of about 0.15:1 to about 0.30: 1;

(e) passing $CO_2$ into and through the heated sulfonate mixture for a period of about 60 to about 240 minutes;

(f) separating the solids from the liquid of the sulfonate mixture;

(g) adding a diluent oil to the $CO_2$ treated sulfonate mixture; an (h) stripping the hydrocarbon solvent from the resulting over-based oil soluble sulfonate product having a 500 TBN.

DETAILED DESCRIPTION OF THE INVENTION

According to the present invention, there is provided new process for making a 500 TBN overbased sulfonate has been developed. A high synthetic sulfonate e.g. (dialkyl benzene sulfonate) to natural sulfonate ratio in the sulfonate feedstock coupled with the use of a low molecular weight pale oil diluent is essential to make a fluid product. The lime to sulfonate charge ratio is crucial to achieve the 500 overbased sulfonate, and the critical ratio of synthetic sulfonate to natural sulfonate is essential to successfully produce an base oil-compatible product. This process produces a clear product with low solid waste.

Examples of useful and preferred reactants which may be employed in the practice of the invention are listed below in Table II.

TABLE II

| Reactants | Example | Preferred Reactants |
|---|---|---|
| Calcium Oxide | | One with a total slaking time of 4.5 to 35 min. and a temperature rise of 6° C. max in the 1st 30 sec. as measured by ASTM C-1000 76 a. |
| Calcium Sulfonate | Neutralized sulfonic and acid derived from a natural feedstock. Neutralized sulfonic acid derived from a synthetic feedstock. Blends of neutralized sulfonic acids from natural and synthetic feedstocks. | Blends of neutralized sulfonic acids from natural synthetic feedstocks. |
| Natural Sulfonate | Petroleum sulfonate, from crude oil | Synthetic Sulfonate and CaO |
| Diluent Oil | 100-500 SUS (at 40° C.) pale stock. 100-500 SUS solvent neutral oil. | 100 SUS pale stock hydrofinished |
| Hydrocarbon Solvent | Straight run gasoline dehexanized raffinate gasoline, normal or mixed hexanes, normal or mixed heptanes, benzene or toluene. | Crude heptane |
| Lower alcohols | ($C_1$-$C_5$) normal or branched chain alcohols | Methanol |

In the present process for overbasing calcium sulfonates a mixture of water, calcium oxide and calcium hydroxide are reacted with a synthetic and a natural sulfonate in specified molar ratios. The entire charge of water is added before the carbonation of the sulfonate mixture in an amount of 15 to 30 mole % of the calcium oxide. A clear product with a low solid waste is produced.

It is known to produce overbased sulfonates by means of calcium oxide alone or a mixture of calcium oxide and calcium hydroxide. Overbased sulfonates produced from calcium oxide-calcium hydroxide mixtures, however, are noted for a hazy product with a relatively low level of overbasing. The instant invention is distinguished in the recognition that the synthetic to natural sulfonate molar ratio is critical to effectively produce a base oil compatible product. The calcium oxide:sulfonate charge molar ratio is essential to produce a clear, low solids content of a 500 TBN overbased sulfonate.

The operating parameters of the present process are tabulated below in Table I.

TABLE I

| Variable | Operable Range | Preferred Range |
|---|---|---|
| Reaction Temperature | 100° to 170° F. | 130° to 140° F. |
| Pressure | 1 to 5 atm | 1 to 2.5 atm |
| Mole ratio $CaO/Ca(OH)_2$ | 90:10 to 20:80 | 80:20 to 50:50 |
| Mole ratio $H_2O/CaO$ | 0.15 to 1.0 | 0.3 to 1.0 |
| Mole ratio $CO_2/[CaO + Ca(OH)_2]$ | 0.5 to 0.95 | 0.6 to 0.9 |
| Charge Mole Ratio $[CaO + Ca(OH)_2]$: Sulfonate | 27:1 to 22:1 | 25:1 to 23:1 |
| Mole ratio Synthetic: Natural Sulfonate | 70:30 to 50:50 | 65:35 to 55:45 |
| Hydrocarbon Solvent | 40 to 70 wt. % | 45 to 65 wt. % |
| Alcohol | 4.5 to 10.0 wt. % | 5.0 to 8.0 wt. % |
| Carbonation and Hydration time | 60 to 240 min. | 60 to 180 min. |

The advantages of the present invention are more clearly apparent when considering the following examples and results thereof.

EXAMPLE I

A blend containing 18.67 parts by weight dialkyl benzene sulfonate (synthetic calcium sulfonate) 6.9 parts petroleum sulfonate, 91 parts heptane, 8 parts methanol, 0.1 part calcium chloride, 10.82 parts calcium oxide, and 9.53 parts calcium hydroxide was brought to reflux in a (60C.) in a 500 ml 4-neck reaction flask. The resultant mixture was refluxed for 10 minutes. Water, 0.9 part, was added immediately before the $CO_2$ charge. $CO_2$ was then introduced into the reaction mixture at a rate of 40 ml/min. The $CO_2$ treatment was stopped at 135 minutes after the $CO_2$ bubbling had started. At the end of the reaction, 4.3 part of a low molecular weight pale oil was added after the crude product was filtered.

The filtered and solvent-stripped final product (Res 250A notebook N38925 Page 38) had a TBN of 505, a kinemtic viscosity at 100° C. of 334 cst. The product contains 19.3% calcium sulfonate and 18% total calcium. The IR spectrum of the product indicates that its calcium carbonate is amorphous.

EXAMPLE II

A blend containing 74.69 parts by weight synthetic sulfonate (dialkyl benzene sulfonate), 27.63 parts petroleum sulfonate, 0.344 part calcium chloride, 364 parts heptane, 31.6 parts methanol, 43.28 parts calcium oxide, and 38.12 parts calcium hydroxide was brought to reflux (60° C.) in a 2 liter, 4-neck reaction flask. The resultant mixture was refluxed for 10 minutes. Water, 3.6 parts, was added immediately before the $CO_2$ charge. $CO_2$ was then introduced into the reaction mixture at a rate of 190 ml/min. The $CO_2$ treatment was stopped 120 minutes after the $CO_2$ bubbling had started. At the end of the reaction, 17.34 parts low molecular weight pale oil was added after the crude product was filtered.

The filtered and solvent-stripped final product had a TBN value of 50I (Res 250A notebook 38988 page 20) and a kinematic viscosity at 100 C. of 460 cst. The product contains 19.06% Ca.

EXAMPLE III

A blend containing 4.00 parts by weight synthetic sulfonate, 7.50 parts petroleum sulfonate, 0.04 parts calcium chloride, 37.70 parts heptane, 3.24 parts methanol, 4.44 parts calcium oxide, and 3.9 parts calcium hydroxide was brought to reflux (60° C. in a ten gallon reactor. The resultant mixture was refluxed for 10 minutes. Water, 0.37 parts, was added immediately before the $CO_2$ charge. $CO_2$ was then introduced into the reaction mixture at a rate of 5.6 l/min. The $CO_2$ treatment was stopped 180 minutes after the $CO_2$ bubbling had started. At the end of the reaction, 0.98 parts low molecular weight pale oil was added after the crude product was filtered.

The filtered and solvent-stripped final product had a TBN of 492 and a kinematic viscosity at 100° C. of 173 cst. The product contains 20.03% calcium.

The effect of the synthetic sulfonate on the final product of this invention is provided below in Table III.

TABLE II

EFFECT OF THE SYNTHETIC SULFONATE CONTENT ON THE FINAL PRODUCT'S KINEMATIC VISCOSITY AND ITS COMPATIBILITY WITH BASE OILS.

| % SYNTHETIC SULFONATE | KINEMATIC VISCOSITY AT 100° C. CST | COMPATIBILITY WITH THE BRIGHT STOCK BASE OIL |
|---|---|---|
| 60 | 206.6 | CLEAR |
| 65 | 206.0 | CLEAR |
| 67.5 | 173.0 | CLEAR |
| 69 | 164.2 | CLEAR |
| 75 | — | HAZE |
| 81.5 | 74.9 | HAZE |

The results of the coker test on the final product, i.e., overbased salt are provided below in Table IV.

TABLE IV

MODIFIED PANEL COKER TEST RESULTS[1]

| | | |
|---|---|---|
| Test Conditions: | Panel Temp. | 330 C |
| | Sump Temp. | 150 C |
| | Duration | 18 hours |
| | Air Flow | 6.3 l/h |
| | Splasher | 1000 r/min |
| | Blend[2] | Blend 588-6853[3] |
| Deposits, mg | 48.5 | 26.5 |
| Color | 50 | 50 |

TABLE IV-continued

| | | |
|---|---|---|
| Carbon, % | 0 | 0 |
| Streaks | slight | slight |
| Vis increase, % | 26.1 | 26.5 |
| Dir Ox, abs/cm | 22.9 | 28.5 |
| Dir Nitr, abs/cm | 0.2 | 2.2 |
| Vis @ 100° C. mm2/s | 15.05 | 14.4 |
| Vis @ 40° C., mm2/s | 146.1 | 140.2 |
| TBN, mg KOH/g | 80.6 | 82.2 |

Note:
[1]Modified Panel Coker Test is the bench test for marine diesel performance.
[2]Formulated with a 400 TBN commercial overbased sulfonate.
[3]Formulated with a 500 TBN overbased sulfonate produced by this invention.

What is claimed is:

1. A process for producing an overbased oil-soluble calcium sulfonate having a TBN of 500, said process comprising:

(a) diluting a synthetic sulfonate and a natural sulfonate in a molar ratio of synthetic to natural sulfonate of about 70:30 to about 50:50, with a hydrocarbon solvent and a lower alkanol;

(b) adding to the diluted natural/synthetic sulfonate solution, CaO and $Ca(OH)_2$ and H20 in molar ratios of $CaO:Ca(OH)_2$ of about 90:10 to about 20:80 and a charge molar ratio of total lime [CaO and $Ca(OH)_2$]: sulfonate of about 27:1 to about 22:1;

(c) heating the sulfonate mixture to a temperature of about 100 ° F. to about 170° F. under a pressure ranging from about 0 to about 50 psig;

(d) adding water to said heated sulfonate mixture in a molar ratio of $CaO:H_2O$ of about 0.15:1 to about 0.30:l;

(e) passing $CO_2$ into and through aid heated sulfonate mixture for a period of about 60 to about 240 minutes;

(f) separating the solids from the liquid of the sulfonate mixture;

(g) adding a diluent oil to the $CO_2$ treated sulfonate mixture; and (h) stripping the hydrocarbon solvent from the resulting over-based oil soluble sulfonate product having a TBN of 500.

2. The process of claim 1 wherein the molar ratio of synthetic sulfonate to natural sulfonate ranges from about 65:35 to about 55:45.

3. The process of claim 1 wherein the molar ratio of $H_2O:CaO$ ranges from about 0.2:1 to about 0.3:1.

4. The process of claim 1 wherein the charge molar ratio of CaO: sulfonate ranges from about 25:l to about 23:l.

5. The process of claim 1 wherein the hydrocarbon solvent is selected from the group consisting of a ($C_5$–$C_{15}$) alkane, toluene, xylene and naphthalene.

6. The process of claim 1 wherein the alkanol is a ($C_1$–$C_4$) alkanol.

7. The process of claim 1 wherein the $CO_2$ is passed into the sulfonate mixture for a period ranging from about 60 to about 180 minutes.

8. The process of claim 1 wherein the solid waste volume ranges from about 2.5 percent to about 9.0 percent.

9. The process of claim 8 wherein the solid waste volume is about 8.0 percent.

10. The process of claim 5 wherein said alkane is heptane.

11. The process of claim 6 wherein said alkanol is methanol.

* * * * *